US008844632B2

(12) United States Patent
Pionetti

(10) Patent No.: US 8,844,632 B2
(45) Date of Patent: Sep. 30, 2014

(54) INERTIA TRANSITION PIPE ELEMENT, IN PARTICULAR FOR RESTRAINING A RIGID UNDERSEA PIPE

(75) Inventor: François-Régis Pionetti, La Baleine (FR)

(73) Assignee: Saipem S.A., Montigny Le Bretonneux (FR)

( * ) Notice: Subject to any disclaimer, the term of this patent is extended or adjusted under 35 U.S.C. 154(b) by 790 days.

(21) Appl. No.: 12/988,780

(22) PCT Filed: Apr. 14, 2009

(86) PCT No.: PCT/FR2009/050685

§ 371 (c)(1),
(2), (4) Date: Dec. 16, 2010

(87) PCT Pub. No.: WO2009/138610

PCT Pub. Date: Nov. 19, 2009

(65) Prior Publication Data

US 2011/0083853 A1 Apr. 14, 2011

(30) Foreign Application Priority Data

Apr. 24, 2008 (FR) ..... 08 52773

(51) Int. Cl.
*E21B 17/01* (2006.01)

(52) U.S. Cl.
CPC ..... *E21B 17/017* (2013.01)
USPC ..... 166/345; 166/350; 166/367; 166/355

(58) Field of Classification Search
CPC ..... E21B 17/017
USPC ..... 166/339, 341, 345, 346, 350, 367, 355; 405/224.2, 224.4, 222.44
See application file for complete search history.

(56) References Cited

U.S. PATENT DOCUMENTS

| | | | | |
|---|---|---|---|---|
| 5,722,492 | A * | 3/1998 | Finn | 166/367 |
| 5,865,566 | A * | 2/1999 | Finn | 405/169 |
| 6,220,303 | B1 * | 4/2001 | Secher et al. | 138/110 |
| 7,467,914 | B2 * | 12/2008 | Finn et al. | 405/224.3 |

FOREIGN PATENT DOCUMENTS

| | | | | |
|---|---|---|---|---|
| EP | 0 911 482 | | 4/1999 | |
| EP | 911482 | A2 * | 4/1999 | E21B 17/01 |
| WO | WO 94/09245 | | 4/1994 | |

* cited by examiner

*Primary Examiner* — James Sayre
(74) *Attorney, Agent, or Firm* — Cozen O'Connor

(57) ABSTRACT

An inertia transition terminal pipe element having a main rigid pipe element including at one of its ends an inertia transition piece that is constituted by at least one and preferably a plurality "n" of coaxial reinforcing pipe elements placed coaxially around the main pipe element, each reinforcing pipe element presenting an inside diameter greater than the outside diameter of the main pipe element. The various main and reinforcing pipe elements each being positioned with one end situated at the same level along the axis of symmetry of the pipe elements, and each reinforcing pipe element presenting a length that is less than the height of the main pipe element. The annular gap between the various pipe elements being filled with a solid filler material. A rigid undersea pipe is also disclosed including at at least one of its ends, an inertia transition pipe element.

16 Claims, 7 Drawing Sheets

INERTIA TRANSITION PIPE ELEMENT, IN PARTICULAR FOR RESTRAINING A RIGID UNDERSEA PIPE

CROSS-REFERENCE TO RELATED APPLICATIONS

This is a U.S. national stage of application No. PCT/FR2009/05685, filed on Apr. 14, 2009. Priority is claimed on France Application No. 0852773, filed Apr. 24, 2008, the content of which is incorporated here by reference.

BACKGROUND OF THE INVENTION

Field of the Invention

The present invention relates to an inertia transition pipe element, intended more particularly for being assembled to the end of a rigid undersea pipe, in particular a vertical rigid pipe of the vertical "riser" type.

The present invention relates more particularly to installing production risers for undersea extraction of oil, gas, or other soluble or meltable material, or a suspension of mineral matter, from an undersea well head up to a floating support in order to develop production fields at sea, off shore. The main and immediate application of the invention lies in the field of oil production.

In general, the floating support has anchor means enabling it to remain in position in spite of the effects of currents, winds, and swell. It also generally includes means for storing and processing oil and means for discharging to off-loading tankers, which call at regular intervals in order to take away the production. These floating supports are commonly referred to as floating production storage off-loading supports with the abbreviation "FPSO" being used throughout the description below.

Bottom-to-surface connections are known for an undersea pipe resting on the sea bottom, the connection being of the hybrid power type and comprising:

- a vertical riser constituted by a rigid steel pipe, having its bottom end anchored to the sea bottom via a flexible hinge and connected to a said pipe resting on the sea bottom, with its top end tensioned by a sub-surface float to which it is connected; and
- a connection pipe, in general a flexible connection pipe, between the top end of said riser and a floating support on the surface, and, where appropriate, said flexible connection pipe under the effect of its own weight taking up the shape of a diving catenary curve, i.e. going down well below the float before rising again up to the floating support.

Bottom-to-surface connections are also known that are made by continuously raising up to the sub-surface strong and rigid pipes constituted by thick steel tubular elements that are welded or screwed together and that take up a catenary configuration of continuously varying curvature all along their suspended length, commonly referred to as steel catenary risers (SCRs) and also commonly referred to as rigid catenary risers.

Such a catenary pipe may rise up to the support floating on the surface, or it may rise no further than a sub-surface float that tensions its top end, which top end is then connected to a floating support by a diving flexible connection pipe. Catenary risers of reinforced configuration are described in WO 03/102350 in the name of the Applicant.

In WO 00/49267, SCR rigid pipes are proposed as connection pipes between the floating support and the riser having its top tensioned by a float immersed below the surface, and the float is installed at the head of the riser at a greater distance from the surface, in particular at at least 300 meters (m) from the surface, and preferably at least 500 m.

WO 00/49267, in the name of the Applicant, describes a multiple hybrid tower including an anchor system with a vertical tendon constituted either by a cable or by a metal bar or even by a pipe tensioned at its top end by a float. The bottom end of the tendon is fastened to a base resting on the bottom. Said tendon includes guide means distributed over its entire length with a plurality of said vertical risers passing therethrough. Said base may merely be placed on the sea bottom and rest in place under its own weight, or it may be anchored by means of piles or any other device suitable for holding it in place. In WO 00/49267, the bottom end of the vertical riser is suitable for being connected to the end of a bent sleeve that is movable relative to said base between a high position and a low position, said sleeve being suspended from the base and being associated with return means that urge it towards a high position in the absence of a riser. This ability of the bent sleeve to move enables variations in riser length under the effects of temperature and pressure to be absorbed. At the head of the vertical riser, an abutment device secured thereto bears against the support guide installed at the head of the float and thus holds the entire riser in suspension.

The connection with the undersea pipe resting on the sea bottom is generally provided via a portion of pipe having a pigtail shape or an S-shape, said S-shape being made either in a vertical plane or in a horizontal plane, the connection with said undersea pipe generally being made via an automatic connector.

That embodiment comprising a multiplicity of risers held by a central structure having guide means is relatively expensive and complex to install.

Furthermore, the installation needs to be prefabricated on land prior to being towed out to sea, and then once on site up-ended in order to be put into place. In addition, maintenance thereof also requires relatively high operating costs.

Furthermore, since the crude oil is conveyed over very long distances, i.e. several kilometers, it is necessary to provide an extremely expensive level of insulation, firstly to minimize any increase in viscosity that would lead to a drop in the hourly production rate from the wells, and secondly to avoid the flow becoming blocked by paraffin being deposited or by hydrates forming when the temperature drops to around 30° C. to 40° C. These phenomena are critical because the temperature at the bottom of the sea is about 4° C. and, particularly in West Africa, the crude oils are of the paraffin type.

It is therefore desirable for bottom-to-surface connections to be short in length and thus for the space occupied by the various connections to a common floating support to be limited.

That is why it is desirable to provide installations suitable for enabling a common floating support to operate a plurality of hybrid tower type bottom-to-surface connections that occupy a limited amount of space and that are simple to lay, with it being possible for them to be fabricated at sea on board a pipe-laying ship.

WO 02/066786 and WO 2003/095788 describe hybrid tower installations requiring flexible hinges to be implemented between the vertical riser and the base because of the large variations in angle that are generated by the movements of the FPSO and by the action of swell and current on the pipes and on the float tensioning the vertical portions of the pipe, said angles reaching 5° to 10° and said variations preventing the use of a rigid connection that is restrained in said base. Such flexible hinges are very difficult and expensive to fabricate since they are constituted by stacks of layers of elastomer and steel reinforcement, and they must be capable of withstanding fatigue throughout the lifetime of the installations which may exceed 20 to 25 years or even more. Furthermore, the presence of the floats gives rise to a tension discontinuity at the swan-neck piece forming the interface between the substantially vertical rigid pipe and the flexible pipe in a catenary configuration, and that is harmful to the overall stability at said interface and affects the mechanical strength of the installation.

In WO 02/103153, attempts are made to provide an installation that can be fabricated completely on land, in particular concerning the assembly of the rigid pipes that rest on the sea bottom and the vertical risers that provide the bottom-to-surface connection. Furthermore, in document WO 02/103153, it is sought to implement an installation that requires no flexible ball joint in the bottom portion of the tower in order for it to be put into place on the sea bottom. To achieve that, the undersea pipe resting on the sea bottom is connected to said vertical riser via a flexible pipe element held by a base that is resting on the sea bottom. The assembly comprising the bottom end of the vertical riser connected to the end of the pipe resting on the sea bottom via said flexible pipe element and that is secured to and held by said base is pre-assembled on land prior to being towed out to sea, and is placed on the sea bottom to which said base is subsequently anchored. Nevertheless, that embodiment presents certain drawbacks since the anchor system requires considerable amounts of buoyancy elements during the stages of towing and up-ending in order to counter the apparent weight of said base structure, and the flexible connection elements are subjected to a large amount of fatigue throughout the lifetime of the installations that may reach or exceed 25 to 30 years.

Furthermore, in all of the installations described in the above-mentioned prior art, the vertical riser is tensioned by a sub-surface float and the connection between the vertical riser and the floating support is made via a flexible pipe in a diving catenary configuration, having one end connected to the top end of said vertical riser via a swan-neck device. That technique of connecting the top end of the vertical riser to the floating support presents certain drawbacks in terms of mechanical strength at the tension discontinuity created by the swan-neck connection piece and as a result of the vertical riser being tensioned by a float of very large volume, which means that the float is subjected to the action of currents and swell, thereby giving rise to very large angular variations at the top of the riser in connections of that type, which variations have repercussions at the bottom of the riser in that the flexible hinge is highly stressed thereby.

When flexible pipes are connected to rigid structures, such as the side of an FPSO or of a drilling platform, and with the flexible pipe free to move in any direction, it is necessary to provide reinforcement where it is connected to said rigid support. For this purpose, reinforcement of varying stiffness is generally installed over a length of 2 m to 6 m, which reinforcement is generally made of a thermoplastic or thermosetting material and serves to improve the inertia transition between the main portion of the flexible pipe and its restrained fastening to said rigid support.

The term "inertia" is used herein to mean the second moment of area of said inertia transition pipe about an axis perpendicular to the axis of said inertia transition pipe element, thus representing the bending stiffness in each of the planes perpendicular to the axis of symmetry XX' of said pipe element, said second moment of area being proportional to the product of the section of material multiplied by the square of its distance from said axis of the pipe element.

Similarly, when a rigid pipe suspended in the sea is connected to a fixed support, either via a flexible elastomer hinge or indeed a flexible pipe, the rigid pipe is generally fitted with a coupling flange. The end of the rigid pipe is then generally reinforced over 1 m to 2 m or more by increasing its thickness, e.g. by doubling said thickness and providing a conically-shaped inertia transition zone extending over a length of several meters. Such cylindrical-and-conical parts may be machined without difficulty on lathes that are conventional, but of large capacity.

It is possible to make a restrained connection with a pipe by implementing at its end a pipe element of varying thickness that forms a cylindrical-and-conical transition piece, said piece presenting:

- at its thinner end, an inside diameter that is preferably equal to the inside diameter of said pipe and a thickness that is substantially equal to the thickness of said pipe; and
- at its other end, an inside diameter that is preferably equal to the inside diameter of said pipe and a thickness that is two to ten times greater than the thickness of said pipe.

Such parts may have a length of 15 m to 30 m, the cylindrical portion extending over a length of 3 m to 5 m. Nevertheless, such parts are expensive to fabricate since they need to be made using pipes that are very thick but of various thicknesses that are assembled to one another and then machined on a lathe of very great dimensions in order to obtain the conical shape. Such parts are very expensive to make since in order to obtain a good result it is necessary for the pipe as welded together prior to machining to be accurately rectilinear, and furthermore, lathes capable of accurately machining parts having a length of 20 m to 30 m are difficult to find and of very high operating costs.

In certain extreme cases, cylindrical-and-conical transition pieces cannot be made out of steel and need to be made out of titanium, thereby further increasing costs and complexity.

However, if it is desired to make a good restrained connection with a structure of extreme rigidity, the bending moments that need to be transmitted at the connection proper are considerable and require cylindrical-and-conical transition pieces of size that is extremely large, both in terms of thickness of the reinforced portion and in terms of total length.

EP-0 911 482 describes an inertia transition piece constituted by a plurality of pipe elements of increasing lengths and decreasing diameters, with the annular gap between the various pipe elements being filled with a solid filler material.

In EP-0 911 482, the annular gaps between the various adjacent coaxial pipe elements are closed by welded steel ferrules or bushings.

Insofar as the filler material inside said annular gaps is constituted by some other material, specifically cement, this gives rise to discontinuities in the variation of inertia in the transition piece at each top orifice of an annular gap closed by a said steel ferrule or bushing.

In use, that inertia transition piece does not present sufficiently reliable mechanical restraint at its connection, in particular because of the discontinuous variation of inertia along the piece, given that said piece is not a cylindrical-and-conical transition piece.

More precisely, the transition piece of EP-0 911 482 presents considerable variations in inertia at said ferrules or bushings, thus leading to a phenomenon of accelerated fatigue when said zone is subjected to repeated angular deflections throughout the lifetime of an installation, which may exceed 20 years in difficult conditions. In addition, the entire device as described is not protected against external attack, in particular by sea water.

In the present application, the term "cylindrical and conical" is used to mean that the part is of diameter that varies in cross-section along its axial longitudinal direction in a manner that is progressive and continuous, i.e. without discontinuity, increasing in continuous manner from its smaller-diameter end to its larger-diameter end.

SUMMARY OF THE INVENTION

An object of the present invention is to provide a novel type of cylindrical-and-conical inertia transition piece that is suitable for enabling the end of a rigid pipe to be rigidly restrained, in particular on an anchor device at the bottom of the sea and more particularly, thereby providing an installation that does not require flexible hinges to be provided, in particular at the base of a rigid pipe rising from the sea bottom, i.e. a vertical riser.

Another object of the invention is to provide a bottom-to-surface connection installation with hybrid towers of reduced overall size, that is simple to put into place and can be fabricated at sea from a pipe-laying ship, but in which the anchor system is very strong and of low cost, and for which the methods of fabrication and of installation of the various component elements are simplified and also of low cost, and can be performed at sea, generally from a laying ship.

To do this, the present invention provides an inertia transition terminal pipe element comprising a main rigid pipe element including at one of its ends an inertia transition piece that is constituted by at least one and preferably a plurality n of coaxial reinforcing pipe elements placed coaxially around said main pipe element, each said reinforcing pipe element presenting an inside diameter $d_i$ greater than the outside diameter $D_{i+1}$ of the main pipe element and where appropriate of the other reinforcing pipe element(s) it contains, the various main and reinforcing pipe elements 8*a*-8*d* each being positioned with one end situated at the same level along the axis of symmetry $Z_1Z'_1$ of said pipe elements, and each said reinforcing pipe element 8*b*-8*d* presenting a length $h_i$ with i=2 to n, that is less than the height $h_1$ of the main pipe element, and where appropriate the heights $h_{i+1}$ of the other reinforcing pipe elements that it contains, the annular gap $d_i-D_{i+1}$ between the various pipe elements being filled with a solid filler material.

In the invention, said annular gap is completely filled with a common solid filler material preferably comprising an elastomer material, more preferably a material based on polyurethane, presenting hardness that is greater than or equal to A50 on the Shore scale, and more preferably that lies in the range A50 to D70 on the Shore scale; and said inertia transition element is covered in a corrosion-resistant elastomer covering material, preferably of the polyurethane type, said inertia transition terminal pipe element presenting a substantially cylindrical-and-conical shape as a result of it being covered in said covering material.

In the present invention, because the angular gap is completely filled with the common filler material and because the covering material imparts a cylindrical-and-conical shape to the transition piece, the diameter of the cross-section of said piece is caused to vary continuously while using the common filler material over the entire height of the transition piece, thereby giving rise to variation in inertia that is progressive and continuous, i.e. without any inertia discontinuity. In addition, using an elastomer covering material provides protection against corrosion, thereby guaranteeing longer life for said transition piece, which piece is subjected to high levels of mechanical stress and without such protection would present a shortened lifetime.

It can be understood that said solid filler material needs to present resistance to compression that enables it to transfer shear forces to the reinforcing element of higher order "i+1" in a manner that is proportional to the deformation of a said coaxial element that it contains of order "i" under the effect of a bending force applied thereto. In practice, the solid filler material needs to present a Poisson's ratio lying in the range 0.3 to 0.49, and preferably in the range 0.4 to 0.45.

It can be understood that this type of inertia transition pipe element of the invention is advantageous because of its simplicity of fabrication and is therefore much less expensive than are pipe elements presenting a cylindrical-and-conical inertia transition piece constituted by a single pipe element of varying wall thickness of the kind known in the prior art.

As explained below, this novel type of terminal inertia transition pipe element makes it possible to implement bottom-to-surface connection installations with a rigid riser pipe anchored via rigid restraint to a base located on the sea bottom, i.e. without needing to have recourse to a flexible hinge, in particular of the flexible ball joint type.

The elastomer may be rubber or polyurethane on its own or in combination with a mineral filler such as sand.

In a variant embodiment, said solid filler material is in the form of a particulate material, preferably sand, and/or a hydraulic binder such as cement:

Preferably, for practical fabrication and cost reasons and also in order to increase flexibility and thus length of life of the transition piece, said covering material and said filler material comprise the same elastomer material, preferably based on polyurethane.

More preferably, said solid filler material comprises a polyurethane having hardness of A90 or A95 on the Shore scale.

In another variant embodiment, the solid filler material comprises an elastomer filled with a particulate material, preferably with sand.

According to other more particular characteristics of an inertia transition pipe element of the present invention:

- the difference between the inside diameter d1 of said main pipe element and the outside diameter D4 of said largest-diameter reinforcing pipe element lies in the range three times to ten times the thickness of said main pipe element, and the number n of said coaxial reinforcing elements lies in the range 2 to 4; and
- the difference in length between the various coaxial reinforcing pipe elements ($h_{i-hi+1}$) is substantially constant and is equal to $$\left(h_i \times \frac{1}{n}\right)$$

- the annular gap between two said pipe elements is greater than or equal to the thickness of said smaller-thickness pipe element and less than or equal to twice the thickness of said greater-thickness pipe element defining said annular gap;
- the length of said main pipe element lies in the range 10 m to 50 m and preferably in the range 20 m to 30 m, and it has two or three of said coaxial reinforcing elements.

In other words, it can be understood that the stepwise difference in height from one coaxial pipe element to the next that contains it or that it contains is substantially constant.

In a particular embodiment, the various main and coaxial reinforcing pipe elements are fastened to a common bottom plate constituted by a first fastener flange suitable for enabling leaktight connection with a second fastener flange at the end of a terminal rigid pipe element of another rigid pipe.

Preferably, each of said main and coaxial reinforcing pipe elements is constituted in full or in part by a standard unit pipe element, in particular of steel undersea pipe, or is constituted by a plurality of standard unit pipe elements assembled together end-to-end and preferably held coaxially by centering spacers 18 distributed regularly along their longitudinal direction and around their circular section in their annular gaps.

The present invention also provides a rigid undersea pipe, preferably a bottom-to-surface pipe comprising at one of its ends a said inertia transition pipe, said main pipe element preferably presenting thickness greater than or equal to the thickness of said rigid undersea pipe, and an inside diameter that is substantially identical.

More particularly, for coupling purposes, the pipe of the invention has equipment of stiffness greater than that of said rigid pipe.

Still more particularly, said equipment of greater stiffness is constituted by a pipe coupling element preferably including a fastener flange, said element being situated at the level of a base resting on the sea bottom, or at the side of a floating support or of a buoy on the surface or at sub-surface.

The present invention also provides a bottom-to-surface connection installation, in particular at great depth of more than 1000 m, comprising:

a) at least one rigid pipe having at one end an inertia transition pipe element of the invention, said rigid pipe being a substantially vertical riser pipe fastened at its bottom end to an anchor device at the bottom of the sea; and b) at least one flexible connection pipe providing the connection between a floating support and the top end of said vertical riser, the installation being characterized in that:

1) one end of said flexible pipe is directly connected, preferably via a flange system, to the top end of said vertical riser, a terminal portion of the flexible pipe beside its junction with the top end of said riser presenting positive buoyancy, and at least a top portion of said vertical riser also presenting positive buoyancy, such that the positive buoyancies of said terminal portion of the flexible pipe and of said top portion of said vertical riser enable said riser to be tensioned in a position that is substantially vertical and enables the end of said terminal portion of the flexible pipe and the top portion of said vertical riser where they are connected together to be in alignment or in continuity of curvature; and 2) the bottom end of said vertical riser includes a said terminal pipe element of the invention forming an inertia transition piece in which the variation of inertia is such that the inertia of said terminal pipe element at its top end is substantially identical to that of the pipe element of the main portion of the vertical riser with which it is connected, said inertia of the terminal pipe element increasing progressively to the bottom end of said inertia transition piece including a first fastener flange enabling the bottom end of said vertical riser to be connected with restraint to said anchor device at the bottom of the sea.

The term "vertical riser" is used herein to designate the ideal position for the riser when it is at rest, it being understood that the axis of the riser may be subjected to angular movements relative to the vertical and that it may move within a cone of angle a at the vertex that corresponds to the point at which the bottom end of the riser is fastened to said base.

The term "continuity of curvature" between the top end of the vertical riser and the flexible pipe presenting positive buoyancy means that said curvature does not present any singularity, such as a sudden change of the angle of inclination of its tangent or a point of inflection.

Preferably, the slope of the curve formed by the flexible pipe is such that the inclination of its tangent relative to the axis $Z_1Z'_1$ of the top portion of said vertical riser increases continuously and progressively from the point of connection between the top end of the vertical riser and the end of said flexible pipe terminal portion of positive buoyancy, without any point of inflection and without any point of curvature reversal.

The installation of the present invention thus makes it possible to avoid tensioning the vertical riser with a surface or sub-surface float from which the top end of the riser is suspended, and also makes it possible to avoid the connection to said diving flexible pipe being made via a swan-neck device of the kind used in the prior art. This results not only in greater intrinsic reliability in terms of mechanical strength over time for the connection between the vertical riser and the flexible pipe, given that swan-neck type devices are fragile, but also, and above all, in an installation that provides greater stability in terms of the angular variation ($\gamma$) in the angle of excursion of the top end of the vertical riser relative to an ideal rest position that is vertical, since, in practice, said angular variation is reduced to a maximum angle that does not exceed 5°, and in practice is about 1° to 4° in an installation of the invention, whereas in embodiments of the prior art, the angular excursion may be as much as 5° to 10°, or even more.

Another advantage of the present invention lies in that because this angular variation of the top end of the vertical riser is small, it is possible at its bottom end to make use of a rigid restrained connection on a base resting on the sea bottom without having recourse to an inertia transition piece of dimensions that are excessive and thus too expensive. It is thus possible to avoid implementing a flexible hinge, in particular of the flexible ball joint type, on condition that the junction between the bottom end of the riser and said restrained connection includes an inertia transition piece.

The positive buoyancies of the riser and of the flexible pipe may be provided in known manner by peripheral floats surrounding said pipes coaxially, or preferably, for the rigid pipe of the vertical riser, a coating of positive buoyancy material, preferably also constituting a lagging material, such as syntactic foam, in the foam of a shell in which said pipe is wrapped. Such buoyancy elements that are capable of withstanding very high pressures, i.e. pressures of about 10 megapascals (MPa) per 1000 m of depth of water, are known to the person skilled in the art and are available from the supplier Balmoral (UK).

More particularly, said flexible pipe presents positive buoyancy over a length corresponding to 30% to 60% of its total length, and preferably to about half the total length of the flexible pipe, such that the flexible pipe presents an S-shaped configuration with a first flexible pipe portion beside said floating support presenting concave catenary curvature in a diving chain configuration and the remaining terminal portion of said flexible pipe presenting inverse catenary convex curvature as a result of its positive buoyancy, the end of said terminal portion of the flexible pipe at the top end of said riser being situated above and substantially in alignment with the axis $Z_1Z'_1$ of said riser at its top end.

The diving flexible pipe portion, i.e. the portion with negative buoyancy may be made correspondingly shorter with increasing stiffness with which the floating support at the surface is anchored.

In a preferred embodiment of a bottom-to-surface connection installation, the installation has the following characteristics, whereby:

said vertical riser is connected at its bottom end to at least one pipe resting on the sea bottom; and said anchor device comprises a support and coupling device fastened to a base placed on and anchored to the sea bottom; and said pipe resting on the sea bottom includes a terminal first rigid pipe element secured to said base resting on the sea bottom and said terminal first pipe element is held stationary relative to said base with a first portion of a coupling element at its end, preferably a male or female element of an automatic connector; and said first fastening flange at the bottom end of said inertia transition piece is fastened to a second fastening flange at the end of a bent second rigid pipe element secured to said support and coupling device fastened to said base and supporting in stationary and rigid manner said bent second rigid pipe element, with the other end thereof including a second coupling element portion complementary to said first coupling element portion and connected thereto when said support and coupling element is fastened to said base.

It can be understood that the static shape of said first rigid pipe element terminating said pipe resting on the sea bed relative to said base, and the static shape of said bent second rigid pipe element relative to said support and coupling device fastened to said base make it possible to position the respective ends of said first and second rigid pipe elements so as to facilitate coupling together the complementary portions of the automatic connectors once the support and coupling device is fastened to said base.

Also preferably, the bottom-to-surface connection installation presents the characteristics whereby:

said base is anchored to the sea bottom by a first tubular pile passing through a through orifice in said base, said first pile being driven into the ground at the sea bottom, and its top portion co-operating with the base in such a manner as to enable said base to be anchored; and said support and coupling device supporting said bent second rigid pipe element includes a second tubular pile, referred to as a tubular anchor insert, that is inserted inside said first tubular anchor pile of said base, said base including a locking device retaining said tubular anchor insert inside said first tubular pile in the event of upward traction being applied to said second tubular pile.

Preferably, said first and second piles are assemblies of standard rigid unit pipe elements or of portions of rigid unit pipe elements, said second pile being shorter than said first pile.

This system for anchoring the base and fastening said support and coupling device at the bottom end of said inertia transition piece to said base is particularly advantageous for the following reasons.

Firstly, the combination of the first pile and of the tubular anchor insert constitutes a guide system that enables said first and second portions of the coupling elements to be made to coincide firstly at the end of the terminal pipe element of the pipe resting on the sea bottom that is in a fixed position relative to said base and secondly at the end of said rigid pipe element that is in a fixed position relative to said support device.

The transverse or shear forces that result from the bending moment occurring at the bottom of the sea via the restrained fastening of the bottom end of the vertical riser to said base as a result of the angular variations of the riser at its top end are not transmitted to said base but rather to said anchor pile, which pile extends deep into the sea bottom over a length of 30 m to 70 m. It is thus possible to use a said base that is of relatively small volume and weight, thereby enabling it to be lowered relatively easily from the surface while secured to said first terminal pipe element of the pipe resting on the sea bottom.

More particularly, said tubular anchor insert is positioned on the axis of said inertia transition piece and said second rigid pipe element supported by said support and coupling device is curved or bent so that said first coupling element portion of the automatic connector type is offset laterally relative to the remainder of said support and coupling device, and said second coupling element portion of the automatic connector type at the end of said terminal first rigid pipe element of said pipe resting on the sea bottom that is secured to said base is also offset relative to the orifice in said base and relative to said support and coupling device in which said anchor insert is inserted inside said first anchor pile.

In this embodiment, said first terminal pipe element of said pipe resting on the sea bottom may preferably likewise be bent one way or the other so as to coincide well with the end of said bent second rigid pipe element so as to make them easy to couple together by means of a remotely-operated vehicle (ROV) at the sea bottom.

The present invention thus also provides a method of putting a bottom-to-surface connection installation of the invention into place at the sea bottom, the method being characterized in that it comprises the following successive steps:

1) lowering a said anchor device to the sea bottom; and 2) lowering a rigid pipe forming a vertical riser that is fastened directly at its top end to one of said flexible pipe and that presents a terminal portion of positive buoyancy, the other end of said flexible pipe being suspended from a sub-surface float; and 3) fastening the bottom end of said transition piece so that it is restrained at said anchor device; and 4) moving the end of said flexible pipe suspended from said float and fastening or connecting it to a said floating support.

Preferably, a method of putting a bottom-to-surface connection installation of the invention into place comprises the following successive steps:

1) lowering a said base secured to a said rigid first pipe element to the sea bottom, said base including a through orifice; and 2) lowering a said first tubular anchor pile to the sea bottom and driving it into the bottom of the sea through said orifice in the base in order to anchor said base to the sea bottom; and 3) from a surface ship, lowering said rigid pipe constituting said vertical riser that is directly fastened at its top end to a said flexible pipe down to the sea bottom, said transition piece at the bottom end of said riser being fastened to a said support and coupling device that supports a bent second rigid pipe element and a said anchor insert; and 4) fastening said support and coupling device to said base by inserting said anchor insert inside said first tubular pile; and 5) preferably locking said anchor insert inside said first tubular pile using a locking device; and 6) connecting together said bent first rigid pipe element and said bent second rigid pipe element; and 7) finishing lowering of said flexible pipe having a terminal portion of positive buoyancy, with the other end of said flexible pipe being suspended from a sub-surface float; and 8) moving and then fastening or connecting the other end of said flexible pipe to a said floating support.

This method of the invention is particularly simple and thus advantageous to implement. This simplicity results from the fact that the function of anchoring to said base is performed by said anchor insert on the underside of said support and coupling device, and the bending moments to which the inertia transition piece is subjected are taken up by the first anchor pile driven into the sea bottom and not by said base, thus making it possible to use a base of relatively small weight and small volume.

BRIEF DESCRIPTION OF THE INVENTION

Other characteristics and advantages of the present invention appear better in the light of the following detailed description made in illustrative and non-limiting manner with reference to the drawings, in which:

FIG. 1 is a side view of a bottom-to-surface connection installation 1 of the invention comprising a riser type rigid pipe 9 that is restrained at its bottom portion in a first pile 6 passing through a base 4, and connected at its top end 9*b* to a flexible pipe 10 that is buoyant over a terminal portion 10*a* of its length, the other end of the pipe being connected to a floating production storage off-loading (FPSO) support 12;

Figures 2A, 2B, 2C:
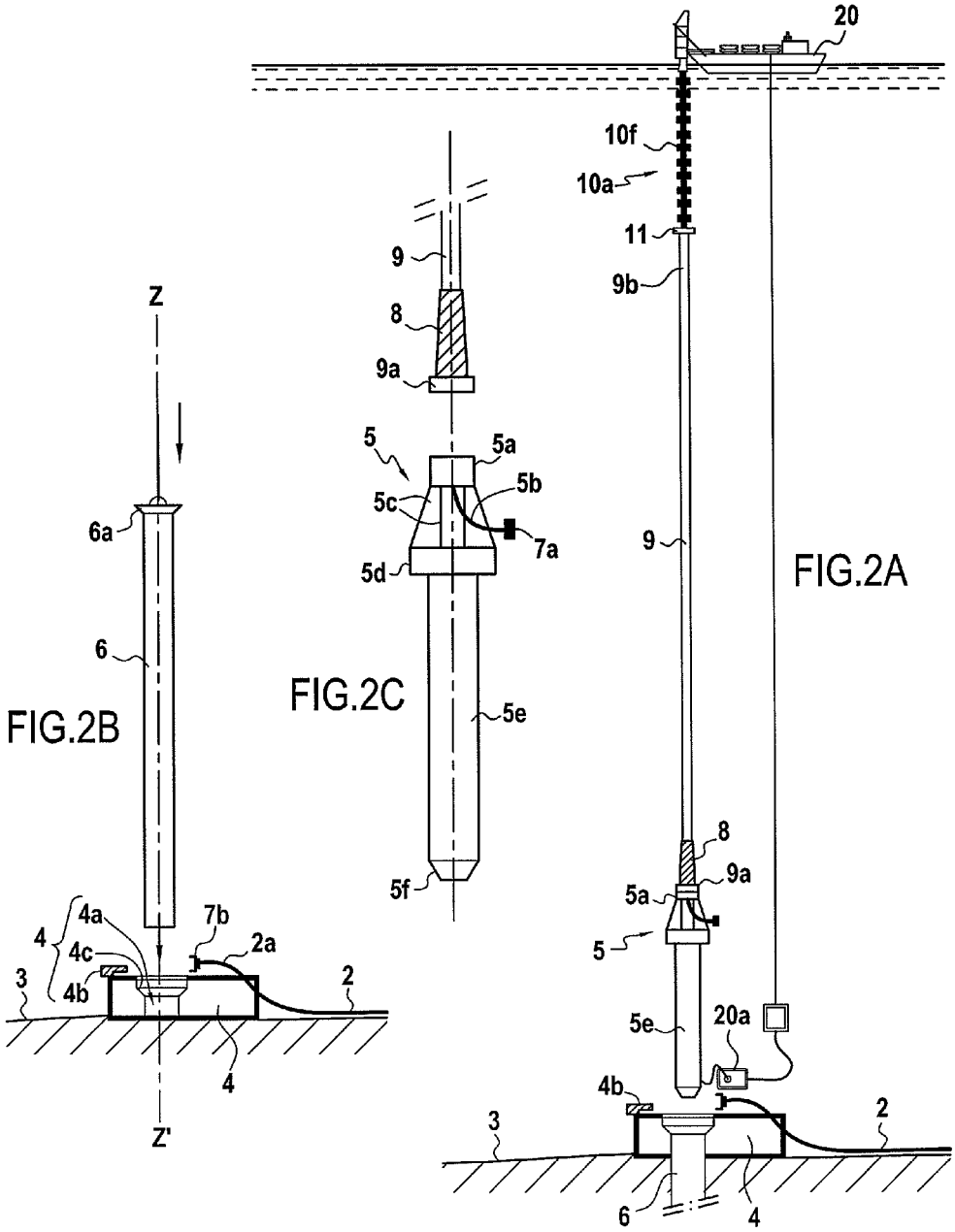
FIG. 2A is a side view of the bottom-to-surface connection installation without its base while it is being put into place from a utility ship 20.
FIG. 2B is a side view of a said first anchor pile 6 being put into place in a base supporting the end of an undersea pipe resting on the sea bottom.
Figure 3:
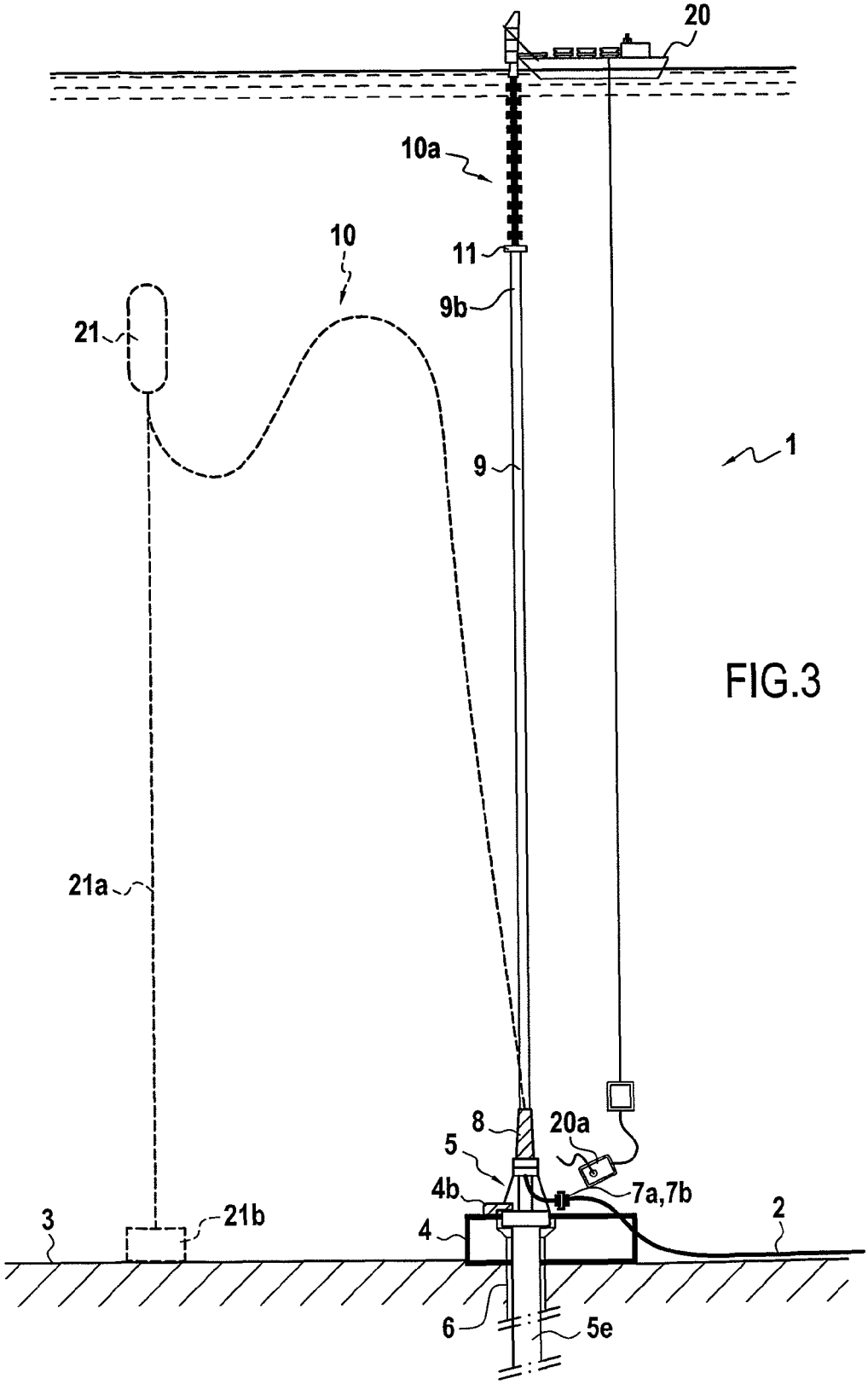
Figure 3A:
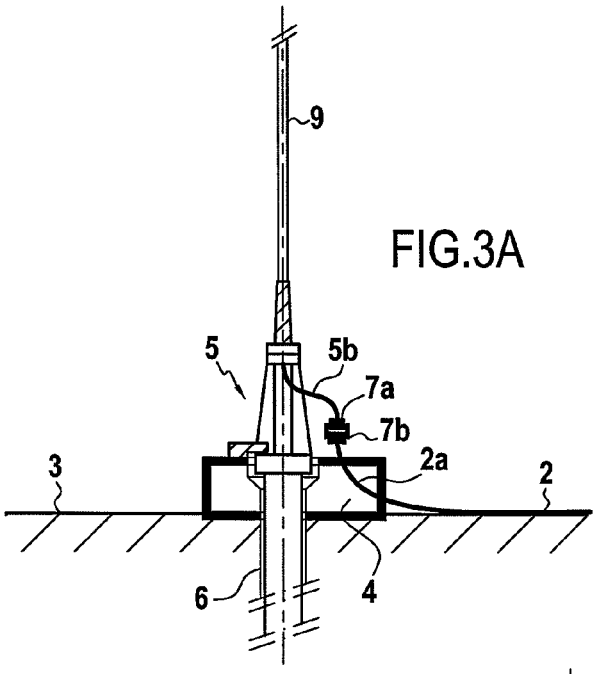
Figure 3B:
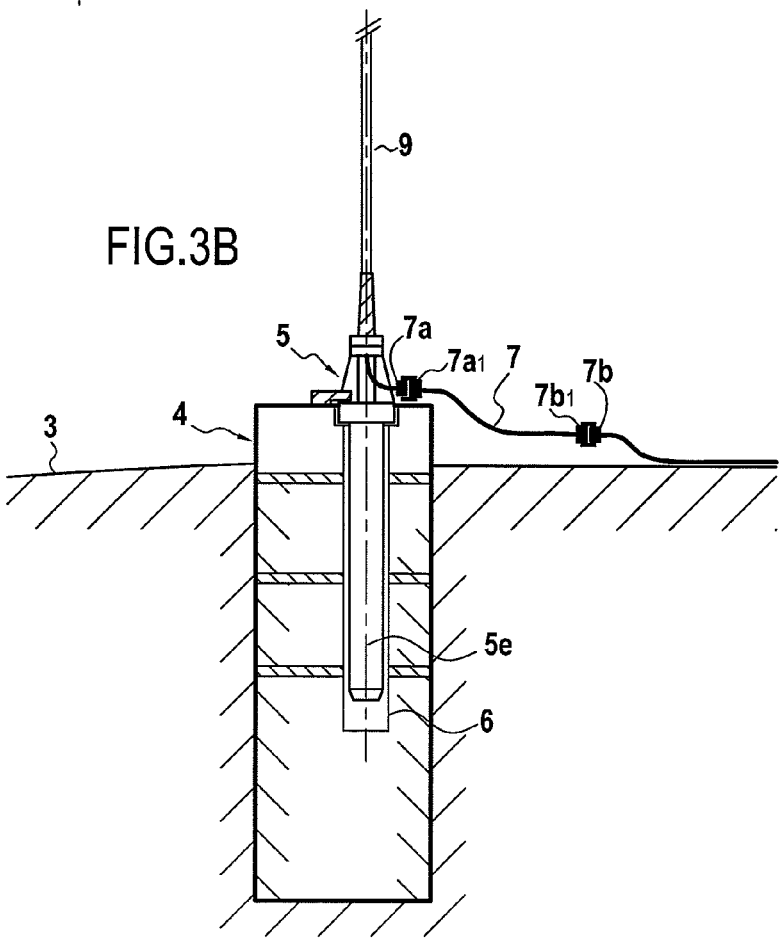
Figure 4:
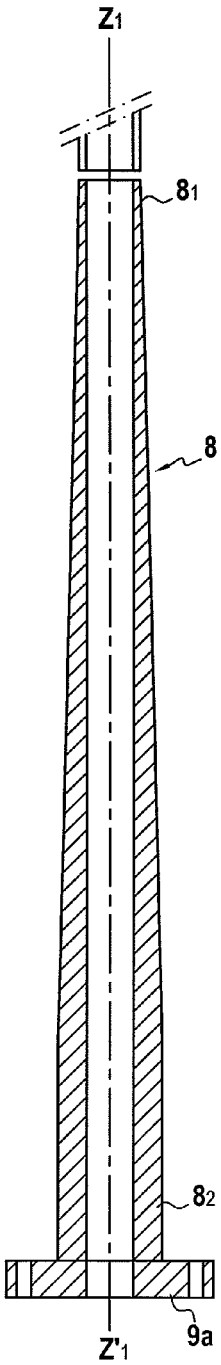
Figure 5A:
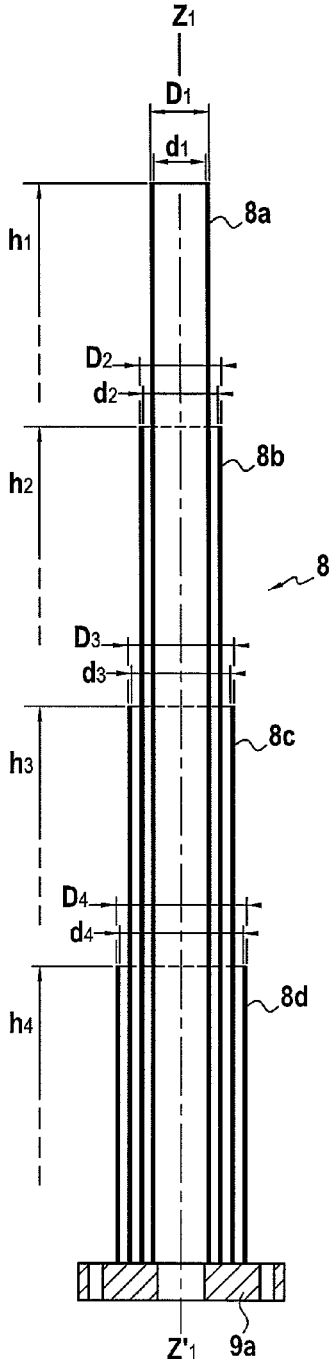
Figure 5B:
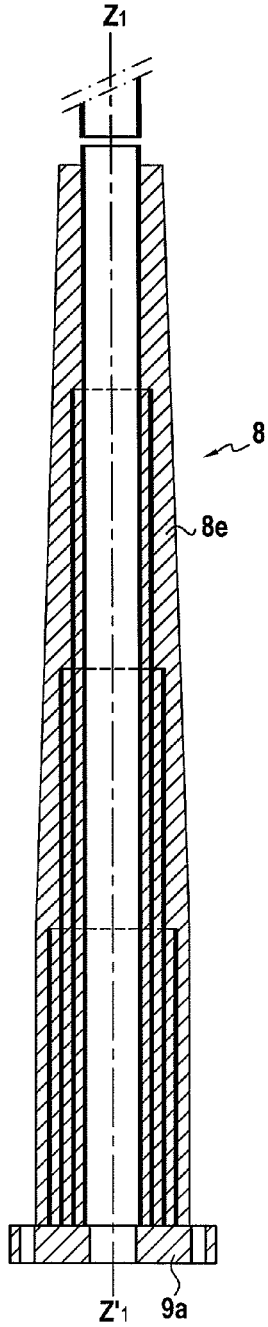
Figure 5C:
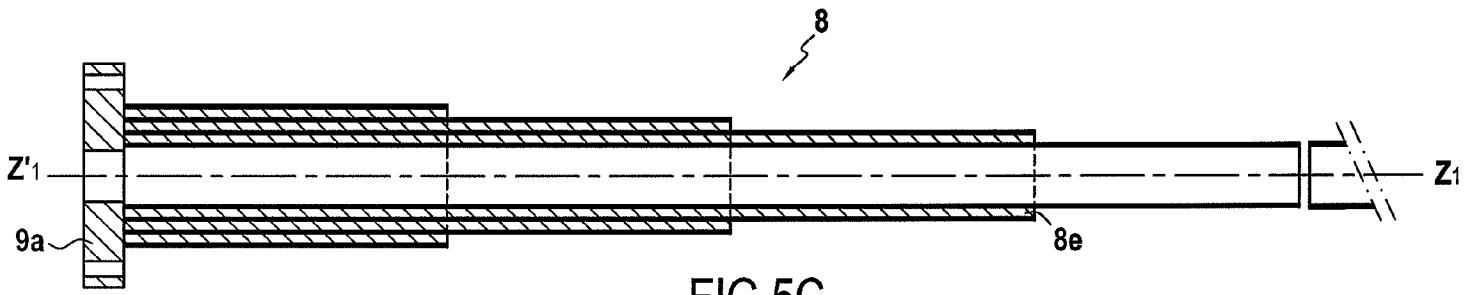
Figure 6:
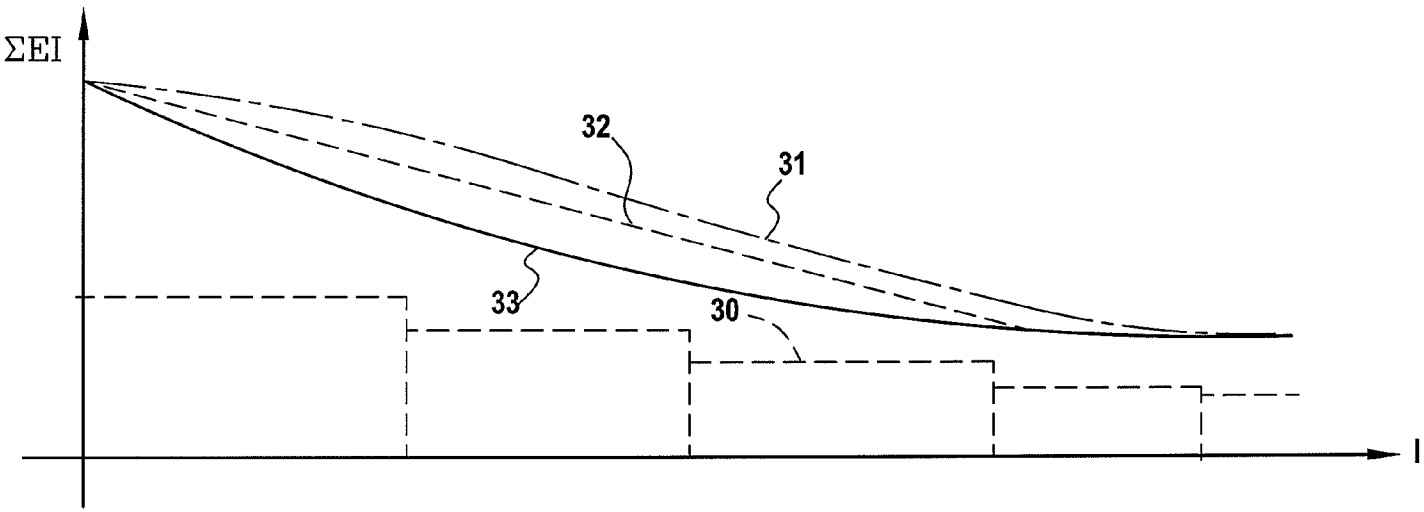
Figure 7:
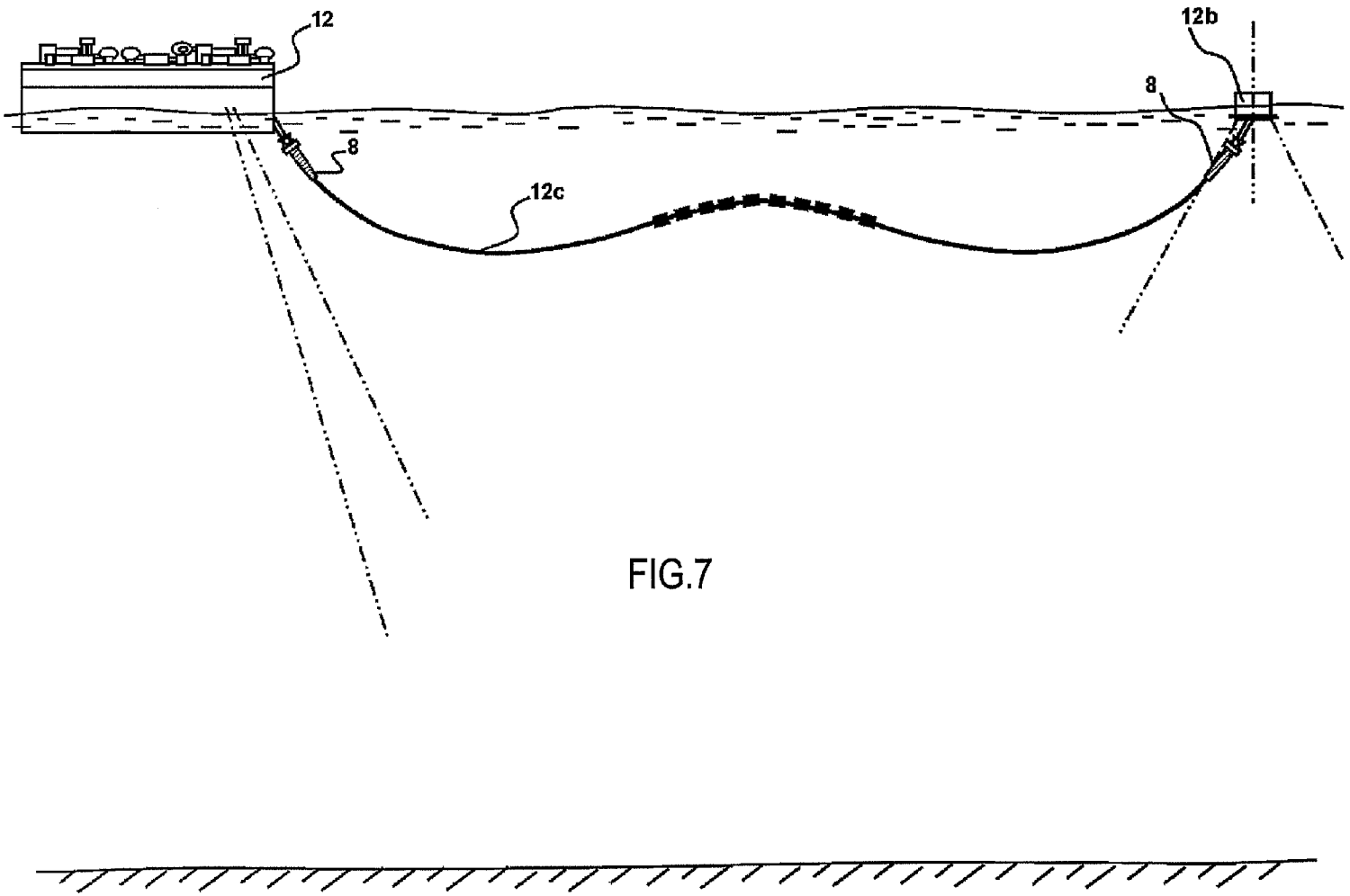

FIG. 2C is a side view of the bottom end of the riser 9 with an inertia transition piece 8 at its connection to a support and coupling device 5 that includes a tubular insert 5*e* for anchoring inside said anchor pile 6;

FIG. 3 is a side view of the bottom-to-surface connection installation while it is being put into place, after the anchor insert 5*e* has been engaged in the anchor pile 6;

FIGS. 3A and 3B are a side view and a section view showing two variant bases for coupling to a pipe resting on the sea bed in a bottom-to-surface connection installation of the invention;

FIG. 4 is a section view and a side view of a massive steel transition piece 8 of conical shape installed at the bottom end of the riser 9;

FIGS. 5A, 5B, and 5C are section and side views of a preferred variant embodiment of a transition piece made up of coaxial stacks of steel pipes, with the gaps between them being filled by elastomer materials in FIGS. 5B and 5C;

FIG. 6 is a graph plotting variation in the inertia of the transition pieces of FIG. 5C; and FIG. 7 is a side view of a sub-surface connection in a W configuration between an FPSO and an offloading buoy, having at each of its ends a transition piece of the invention.

FIG. 7 is a side view of an FPSO 12 connected to an offloading buoy 12*b* by a crude oil export pipe 12*c* constituted by a large-diameter rigid steel pipe, said steel pipe being fitted at each of its ends with an inertia transition piece 8 of the invention. Such inertia transition pieces 8 are advantageously used at the ends of rigid pipes 12*c* when they are secured to a pipe coupling element 13, preferably including a fastener flange or any other piece of equipment of stiffness greater than that of the rigid pipe 12*c*.

DETAILED DESCRIPTION OF THE PREFERRED EMBODIMENTS

Figure 1:
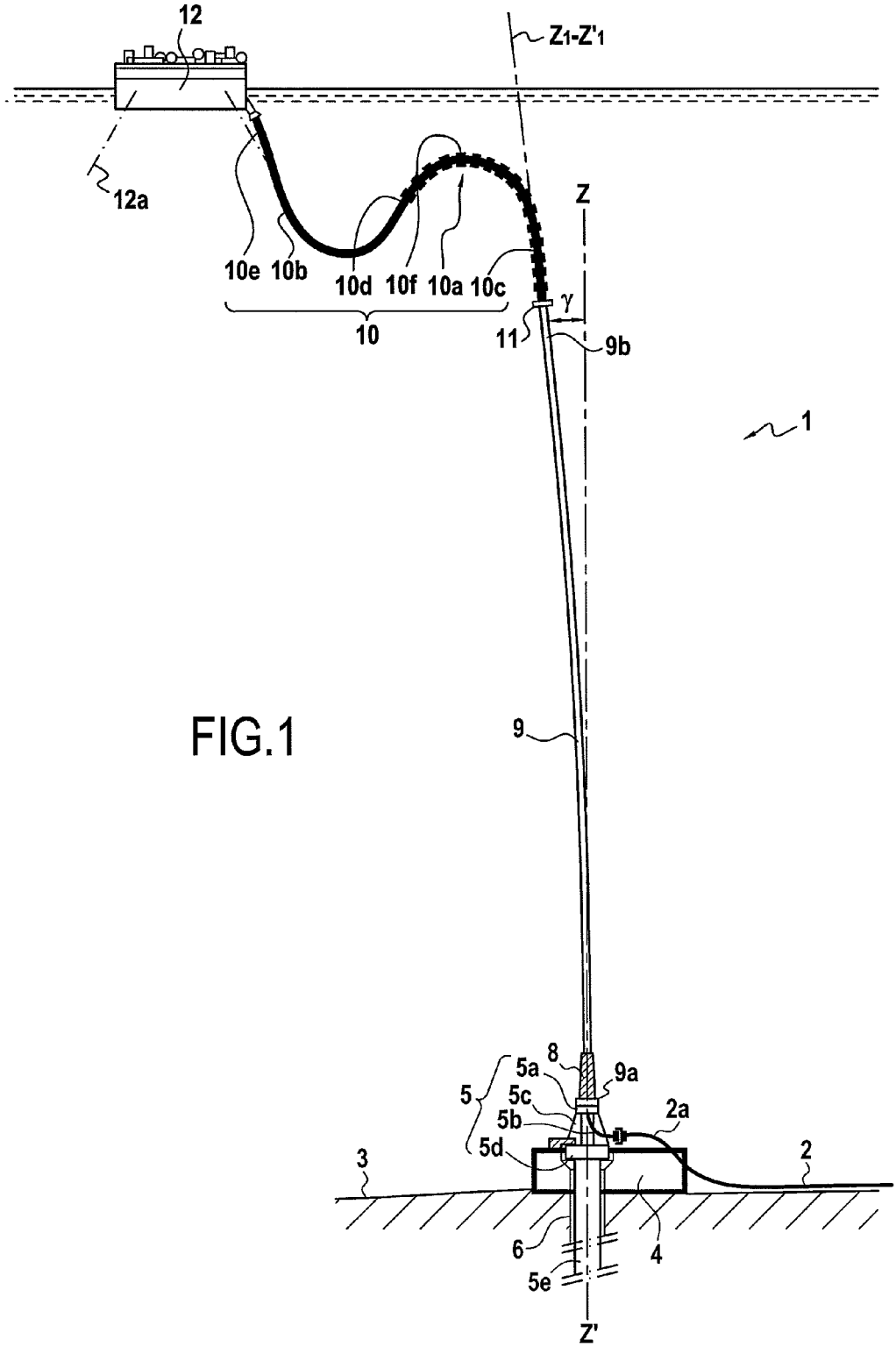

FIG. 1 shows a bottom-to-surface connection installation 1 connecting an undersea pipe 2 resting on the sea bottom 3 to an FPSO type floating support 12 on the surface and moored by anchor lines 12*a*.

Going from the support 12 on the surface to the base at the sea bottom, an installation of the invention comprises the following elements:

a) a flexible pipe 10 having a concave first portion 10*b* that extends from the end 10*e* of the flexible pipe that is fastened to the floating support 12 to about halfway along the flexible pipe in the form of a diving catenary configuration due to its negative buoyancy down to a point of inflection at 10*d* that is substantially halfway along the flexible pipe, the terminal portion 10*a* extending from the central point of inflection 10*d* to the end 10*c* of the flexible pipe presents positive buoyancy as a result of a plurality of floats 10*f* that are preferably regularly spaced apart along and around said terminal portion 10*a* of the flexible pipe; and b) a rigid riser pipe 9 made of steel, referred to as a "vertical riser" that is fitted with buoyancy means (not shown) such as half-shells of syntactic foam that are preferably distributed uniformly over all or part of the length of said rigid pipe, and including at its bottom end an inertia transition piece 8 fitted with a first fastening flange 9*a* at its bottom end. The first fastening flange 9*a* is fastened to a second fastening flange 5*a* constituting the top portion of a support and coupling device 5 that is itself anchored in the first pile 6 that is secured to the base 4 resting on the sea bottom, said support and coupling device 5 enabling the bottom end of the riser 9 to be coupled to a pipe 2 resting on the sea bottom, as explained below.

The flexible pipe presents continuous variation of curvature, initially concave in its diving catenary configuration portion 10*b*, and then convex in its terminal portion 10*a* with positive buoyancy, there being a point of inflection 10*d* between them, thus forming an S-shape lying in a substantially vertical plane.

In operation, as shown in FIG. 1, when the top portion of the rigid pipe 9 is inclined at an angle of inclination $\gamma$ relative of the vertical ZZ', the end 10*c* of the terminal portion having positive buoyancy 10*a* of the flexible pipe remains substantially in axial alignment $Z_1Z'$ with the top end 9*b* of the rigid pipe 9, and in any event in continuity of curvature with said top end. This provides better strength to the leaktight fastening 11 between the two pipes and avoids any need to implement a swan-neck type device as is implemented in the prior art.

The advantage of this flexible pipe is that its diving initial portion 10*b* serves to damp any excursions of the floating supports 12 so as to stabilize the end 10*c* of the flexible pipe that is connected to the rigid rising pipe of the vertical riser 1.

The end of the buoyant terminal portion 10*c* of the flexible pipe carries a first fastener flange element 11 for fastening to the top end of a rigid pipe that extends from the sea bottom where it is embedded in a base 4 resting on the sea bottom.

The vertical riser 9 is "tensioned" firstly by the buoyancy of the terminal portion 10*a* of the flexible pipe, and secondly and above all by floats that are regularly distributed over at least the top portion 9*b* and preferably over the entire length of the rigid pipe, the floats being in particular in the form of syntactic foam advantageously acting simultaneously to provide a system with both buoyancy and insulation. These floats and syntactic foam may be distributed along and around the rigid pipe over its entire length, or preferably over only a fraction of its top portion.

Thus, if the base 4 is at a depth of 2500 m, it may suffice to coat the rigid pipe 9 with syntactic foam over a length of 1000 m from its top end, thereby making it possible to use a syntactic foam capable of withstanding pressures that are lower than it would need to be able to withstand at pressures down to 2500 m, and thus of a cost that is much smaller than that of a syntactic foam capable of withstanding pressure at said depth of 2500 m.

The rigid pipe 9 of the invention is thus "tensioned" without implementing a float on the surface or under the surface as in the prior art, thereby limiting the effects of current and swell, and as a result greatly reducing any excursion of the top portion of the vertical riser and thus greatly reducing the forces at the foot of the riser where it is restrained.

The fastening flange system 11 between the top end of the vertical riser 9 and the flexible pipe 10, and the connection between the fastening flanges 9*a* and 5*a* between the bottom end of the inertia transition piece 8 and the coupling support device 5 provide connections that are leaktight between the pipes concerned.

The base 4 resting on the sea bottom supports a bent or curved first terminal pipe element 2*a* of said pipe 2 resting on the sea bottom. This first bent or curved terminal pipe element 2*a* has a male or female first portion of an automatic connector 7*b* at its end, which connector is offset laterally from a through orifice 4*a* in said base, and is positioned in stationary and determined manner relative to the axis ZZ' of said orifice.

The support and coupling device 5 supports a second bent rigid pipe element 5*b* having said second fastening flange 5*a* at its top end and having a female or male second portion of an automatic connector 7*a*, complementary to the portion 7*b* at its bottom end.

A first tubular anchoring pile 6 is lowered from a surface installation ship 20 and then forced, preferably being driven in known manner, through an orifice 4*a* passing vertically through the base 4, until a peripheral projection 6*a* of the top end of said first pile 6 comes against a complementary shape 4*c* at the top portion of said orifice 4*a* of the base. The orifice 4*a* is slightly larger than the first pile 6 so as to allow it to slide freely. When the driving of said first pile has terminated, the base 4 is thus nailed to the sea bed and is not capable of moving sideways or of pivoting about any horizontal axis.

Optionally, a plurality of orifices are provided together with a plurality of said first piles 6.

In the method of the invention of putting a bottom-to-surface connection installation into place, the first step consists in lowering said base to the bottom of the sea from the surface, said base being fitted with said first terminal pipe element 2*a* of the pipe resting on the sea bottom. After said base has been anchored by a said first pile 6, the transition piece 8 is anchored to the bottom end of the vertical riser by being fastened to the support and coupling device 5 that is itself anchored to said base, thereby rigidly restraining the bottom end of the vertical riser.

The support and coupling device 5 is constituted by rigid and stiffening structural elements 5*c* supporting said second fastening flange 5*a* and said second bent rigid pipe element 5*b*, said rigid structural elements 5*c* also providing the connection between said second fastening flange 5*a* and a bottom plate 5*d* supporting on its underface a second tubular pile 5*e* referred to as a tubular anchoring insert.

When the base 4 is anchored to the sea bottom 3 as shown in FIG. 2A, the various elements of the bottom-to-surface connection are prepared on board the surface ship 20, and in particular the strings constituting by pluralities of standard pipe elements are assembled and lowered progressively. The first to be lowered is said device 5 connected in leaktight manner to the bottom end of the vertical riser 9 via the conical transition piece 8, followed by the entire vertical riser fitted with its buoyancy elements, and finally the flexible connection pipe fitted with its buoyancy elements and fastened in direct continuity with the top end of the vertical riser 9.

The rigid pipe 9 is assembled and laid in conventional manner from the ship 20 by assembling together unit pipe elements or strings of unit elements stored on board the surface ship 20 and lowered progressively using a technique that is known to the person skilled in the art and that is described in particular in prior patent applications in the name of the Applicant, from a so-called "J-lay" ship.

When the entire rigid pipe 9 has been fabricated and lowered to the sea bottom, the top end of the pipe 9 is connected in known manner, e.g. by means of flanges 11, to the end of a flexible pipe 10 that, as it is paid out from the laying ship 20, initially takes up a vertical shape as shown in FIG. 2A, since at least its terminal portion 10*a* is made buoyant by means of its buoyancy elements 10*f* that are regularly distributed along the terminal portion 10*a*.

It should also be observed that in conventional manner the rigid steel pipe 9 may be a pipe-in-pipe type pipe that includes an insulation system in the annular space between two coaxial pipes that make up the riser 9 and also an insulation system such as the syntactic foam acting as a buoyancy system as described above.

When the bottom end of the tubular anchoring insert 5*e* is positioned close to and vertically above the orifice 4*a* in the base 4, which bottom end 5*f* is preferably slightly conical in shape, said tubular anchoring insert 5*e* is advantageously guided, more particularly by means of an automatic submarine or remotely-operated vehicle (ROV) 20*a* that is controlled from the surface. Said tubular insert 5*e* has a length of 10 m to 15 m and it then penetrates naturally under its own weight into said first tubular anchoring pile driven into the bottom of the sea over a depth of 30 m to 70 m.

The outside diameter of the tubular anchoring insert 5*e* may be slightly less than the inside diameter of the first pile 6, e.g. 5 centimeters (cm) less, thereby making it easier to guide the tubular insert 5 inside said first pile 6, while also preventing transverse movements in a horizontal plane once the tubular insert 5 is fully inserted, as shown in FIG. 3.

At this moment, a latch 4*b*, which is shown in its retracted position in FIG. 2A, is moved into its engaged position as shown in FIGS. 1 and 3 so as to lock the top plate 5*d* of the tubular insert 5*e* inside said first pile 6, thus preventing any upward movement of the bottom-to-surface connection assembly 1, which is thus restrained via the support and coupling device 5 in the first pile 6 that is secured to said base 4.

After the latch 4*b* has been engaged, the remainder of the flexible pipe is paid out, as shown in FIG. 3 and the top end of the flexible pipe is connected to a temporary sub-surface buoy 21 that is itself connected via a cable 21*a* to a mooring deadman 21*b* resting on the sea bottom.

By proceeding in this way, the entire bottom-to-surface connection 1 is advantageously preinstalled before putting the FPSO support 12 into place, thereby greatly facilitating operations. Once the floating support 12 is in position at the surface, the end 10*e* of the flexible pipe 10 is recovered and is then connected to said FPSO support 12 as shown in FIG. 1, and the temporary buoy 21 together with its mooring 21*b* and its anchoring cable 21*a* are recovered.

The tubular insert 5*e* transmits to said first tubular pile 6 the bending moments that are due to the shearing and transverse forces acting where the inertia transition piece 8 is restrained on the device 5.

The system for fastening the top end of the rigid pipe 9 to the flexible pipe 10 and the tensioning of said pipe imparts greater stability to the top end of the rigid pipe 9 with angular variation $\gamma$ not exceeding 5° in operation.

Thus, the present invention makes it possible to achieve a rigid restraint of the bottom end of the steel rigid pipe 9 relative to the base 4 by using the support and coupling device 5. To do this, the bottom terminal pipe element of the rigid pipe 9 has a conical transition piece 8 of inertia in terms of cross-section that increases progressively from a value that is substantially identical to the inertia of the riser pipe element 9 to which it is connected at the tapering top portion of the inertia transition piece 8, to a value that is three to ten times greater at its bottom portion that is connected to said first fastening flange 9*a*. The coefficient with which the inertia varies depends essentially on the bending moment that the vertical riser needs to withstand at the location of said transition piece, which moment is a function of the maximum excursion of the top portion of the steel rigid pipe 9, and thus of the angle γ. To make the transition piece 8, use is made of steels having a high elastic limit, and under conditions of extreme stress, it may be necessary to fabricate inertia transition pieces 8 out of titanium.

FIG. 4 shows a cylindrical-and-conical inertia transition piece 8 of thickness that varies, increasing progressively from its tapering top portion 81 to its thicker bottom portion 82, with an inside diameter that is constant and corresponds to the inside diameter of a standard rigid pipe and in any event to the inside diameter of said second rigid pipe element 6.

In a preferred version of the invention, shown in section and in side view in FIGS. 5A, 5B and 5C, the inertia transition piece 8 is made up of a steel main pipe element 8*a*, preferably of inside diameter $d_1$ identical to the inside diameter of the main portion of the pipe 9, and preferably of thickness that is equal to or slightly greater than the thickness of said main portion of said pipe 9, and of thickness equal to the thickness of said second bent pipe element 5*b*. To obtain an increase of inertia progressively on approaching the fastening flange 9*a*, a plurality of coaxial pipe elements 8*b*-8*d* of decreasing height $h_2$, $h_3$, $h_4$ are used in succession, each of said coaxial pipe elements having an inside diameter $d_2$-$d_4$ greater than the outside diameter $D_1$-$D_3$ of the preceding coaxial pipe element that it contains, and a length or height that is less than the height of the preceding pipe element, i.e. the pipe element that it contains or covers, and a thickness that is a function of the desired increase in stiffness.

Thus, in FIG. 5A, there is seen a transition piece comprising an inner first pipe element 8*a* and three coaxial reinforcing pipe elements 8*b*, 8*c*, 8*d* of increasing diameters $d_2$, $d_3$, $d_4$ and decreasing lengths $h_2$, $h_3$, $h_4$, each of said coaxial pipe elements being secured at its bottom end to the same said first flange 9*a*. In order to ensure substantially continuous variation of inertia between the small inertia top portion of the transition piece 8 and the high inertia bottom portion situated at the connection with the flange 9*a*, an elastomer material 8*e*, such as polyurethane, is advantageously injected into the annular spaces between said coaxial pipe elements, and the hardness thereof is adjusted so as to obtain the desired stiffness variation, in particular hardness on the Shore scale lying in the range A50 to D70.

It may suffice to inject said rigid material 8*e* only into the annular gaps between the coaxial pipe elements, as shown in FIG. 5C. However, in the invention, a mold is installed so as to obtain a cylindrical-and-conical piece as shown in FIG. 5B, thereby making it possible in a single operation to reinforce the transition piece and to protect it from attack from the external medium by means of an external covering that thus gives its a cylindrical-and-conical shape with inertia transition that is regular and continuous. Care is taken to avoid covering the top portion of the transition piece in thermosetting resin over a length of 20 cm to 50 cm so as to make it possible to assemble it with the bottom end of the rigid pipe 9 by welding on board the installation ship 20.

It can be understood that in order to fabricate the inertia transition piece 8 of the invention, the method is as follows:

- welding the bottom end of the first main pipe element 8*a* of greatest length to the flange 9*a*; and
- inserting around said first main pipe element 8*a* a first reinforcing pipe element 8*b* coaxially thereabout and welding its bottom end to the same flange 9*a*; and
- inserting the second reinforcing pipe element 8*c* around the first reinforcing pipe element 8*b* and welding its bottom end to the flange 9*a*; and
- inserting a third reinforcing pipe element 8*d* of shorter height around the second reinforcing pipe element 8*c*, and welding its bottom end to the flange 9*a*; and
- injecting a thermoplastic or thermosetting material between the various pipe elements, and where appropriate coating their outside surface inside a mold of cylindrical-and-conical shape so as to obtain the desired stiffness and variation of inertia and protection against corrosion.

FIG. 6 is a block showing variation in inertia I plotted up the ordinate between the flange 9*a* and the top end of the inertia transition piece 8 shown in FIGS. 5B and 5C. The dashed-line staircase 30 represents the variation in the section of steel in the absence of covering and filling material engaging each of the reinforcing pipe elements. The curves 31, 32, and 33 represent variation in the inertia (ΣEI) of the transition piece 8 of FIGS. 4 and 5C as a function of its length, depending on the type of filler material. Curve 33 of parabolic shape is obtained with a polyurethane type filler material having hardness of A90 or A95 on the Shore scale, and constitutes a preferred version of the invention. Curve 31 is obtained with a material that is much stiffer, such as very high performance cement, on its own or in combination with a powder filler, such as sand.

By way of example, a transition piece having a length $h_1$ of 18 m is made using a flange 9*a* having a thickness of 200 mm having welded thereon a main pipe element 8*a* with an outside diameter $d_1$=323.85 mm, a thickness of 20.6 mm, and a length $h_1$=18 m, a first coaxial reinforcement 8*b* of outside diameter $d_2$=457.20 mm, thickness of 12.7 mm, and length $h_2$=12 m, a second coaxial reinforcement 8*c* of outside diameter $d_3$=609.6 mm, thickness of 6 mm, and length $h_3$=6 m. Then the assembly is overmolded either in a vertical position or else in an oblique position with a slope of 5% to 30% to facilitate filling and to avoid voids, using a polyurethane resin 8*e* with hardness of A90 or A95 on the Shore scale. The gap between the first pipe 8*a* and the first reinforcement 8*b* is 53.98 mm, the gap between the second reinforcement and the first reinforcement is 70.2 mm. Inertia is increased substantially by a factor k=3 by the first reinforcement 8*b*, and by a factor k=5 by the second reinforcement 8*c*. During casting, suction cycles are advantageously implemented in the mold during filling so as to eliminate as much as possible all undesirable bubbles of air. Because the transition piece is to be installed at very great depth, hydrostatic pressure may have harmful effects on overall mechanical behavior as a result of such bubbles of air collapsing due to the external pressure which is substantially equal to 10 MPa for every 1000 m of depth of water.

FIG. 3A shows the invention with a base 4 laid simultaneously with the undersea pipe resting on the bottom, said base being stabilized by a first pile 6 passing therethrough. However it remains in the spirit of the invention for the base 4 to be constituted by a suction anchor, as shown in FIG. 3B, presenting a preferably circular orifice incorporated in said suction anchor and acting as the pile 6 so as to be capable of receiving the anchoring insert 5*e*. Thus, the support and connection device 5 at the bottom end of the bottom-to-surface connection is restrained directly on the suction anchor that presents a weight of 25 t to 50 t for a diameter of 3 m to 5 m and a height of 20 m to 25 m. In this configuration, the undersea pipe 2 is laid independently and as a result a junction pipe 7 is required that is fabricated on demand after the bottom-to-surface connection and the undersea pipe 2 has been installed. Said junction pipe 7 thus requires two automatic connectors 7*a*-7*a*$_1$ and 7*b*$_1$-7*b*, one at each of its ends, whereas the version described with reference to FIG. 3A requires only one automatic connector 7*a*-7*b*.

The invention is described in a preferred version that is fabricated and installed simultaneously on site from a laying ship 20, however it would remain within the spirit of the invention for the entire assembly to be prefabricated in a workshop on land, and then towed in a substantially horizontal position to the site, and finally up-ended in order to insert the anchoring insert 5*e* in the first tubular pile 6.

The invention claimed is:

1. An inertia transition terminal pipe element comprising a main rigid pipe element including at one of its ends an inertia transition piece that is constituted by a plurality "n" of coaxial reinforcing rigid pipe elements placed coaxially around said main pipe element, each said reinforcing pipe element presenting an inside diameter ($d_{i+1}$) greater than the outside diameter ($D_1$, $D_i$) of the main pipe element and of the other reinforcing pipe element(s) it contains, the various main and reinforcing pipe elements each being positioned with one end situated at the same level along the axis of symmetry ($Z_1Z'_1$) of said pipe elements, and each said reinforcing pipe element presenting a length ($h_i$ with i=2 to n), that is less than the height ($h_1$) of the main pipe element, and the heights ($h_{i-1}$) of the other reinforcing pipe elements that it contains, annular gap ($D_i$–$d_{i+1}$) between the various pipe elements being filled with a solid filler material;

wherein:

said annular gaps over their entire heights are completely filled with a solid filler material presenting hardness that is greater than or equal to A50 on the Shore scale; and said inertia transition terminal pipe element is covered over its entire height in a corrosion-resistant elastomer covering material, said inertia transition terminal pipe element presenting a substantially cylindrical-and-conical shape as a result of it being covered in said covering material, said cylindrical-and-conical shape being a shape in which the diameter of the inertia transition terminal pipe element varies in cross section along its axial longitudinal direction in a manner that is progressive and continuous from its smallest diameter end to its largest diameter end.

2. The inertia transition pipe element according to claim 1, wherein said covering material and said filler material comprise a same elastomer material.

3. The inertia transition pipe element according to claim 1, wherein said solid filler material comprises polyurethane having hardness of A90 or A95 on the Shore scale.

4. The inertia transition pipe element according to claim 1, wherein said filler material comprises an elastomer filled with a particulate material.

5. The inertia transition pipe element according to claim 1, wherein said solid filler material is in the form of a hydraulic binder.

6. The inertia transition pipe element according to claim 1, wherein the difference in length between the various coaxial reinforcing pipe elements ($h_i$–$h_{i+1}$) is substantially constant and equal to $$\left(h_1 \times \frac{1}{n}\right).$$

7. The inertia transition pipe element according to claim 1, wherein any annular gap between two of said pipe elements ($D_{i+1}$–$d_i$) is greater than or equal to the thickness of said thinner pipe element and less than or equal to twice the thickness of said thicker pipe element defining said annular gap.

8. The inertia transition pipe element according to claim 1, wherein the length of said main pipe element is 10 m to 50 m wherein the inertia transition pipe element comprises two or three of said coaxial reinforcing elements.

9. The inertia transition pipe element according to claim 1, wherein the various main and coaxial reinforcing pipe elements are fastened to a common bottom plate constituted by a first fastener flange suitable for enabling leaktight connection with a second fastener flange at the end of a terminal rigid pipe element of another rigid pipe.

10. The inertia transition pipe element according to claim 1, wherein each of said main and coaxial reinforcing pipe elements is constituted in full or in part by a standard steel unit undersea pipe element, or is constituted by a plurality of standard unit pipe elements assembled together end-to-end and held coaxially by centering spacers distributed regularly along their longitudinal direction and around their circular section in their annular gaps.

11. A rigid undersea pipe including at at least one of its ends a said inertia transition pipe element according to claim 1.

12. A method of rigidly restraining the end of a rigid pipe according to claim 11 that, for coupling, has equipment of stiffness greater than that of said rigid pipe.

13. The method according to claim 12, wherein said equipment of greater stiffness is constituted by a pipe coupling element, said element being situated at the level of a base resting on the sea bottom, or at the side of a floating support or of a buoy on the surface or at sub-surface.

14. The rigid undersea pipe according to claim 11, wherein said main pipe element presents thickness ($D_1$–$d_1$) greater than or equal to the thickness of said rigid undersea pipe, and an inside diameter ($d_4$) of said main pipe element is substantially identical to an inside diameter of said rigid undersea pipe.

15. The inertia transition pipe element according to claim 1, wherein said filler material comprises an elastomer material presenting hardness in the range A50 to D70 on the Shore scale.

16. The inertia transition pipe element according to claim 1, wherein said annular gaps being completely filled over their entire heights with the same solid filler material provides a continuous and progressive inertia variation along the axial longitudinal direction of the inertia transition pipe element over the entire height thereof.

* * * * *